US011655978B2

(12) United States Patent
Chambers et al.

(10) Patent No.: US 11,655,978 B2
(45) **Date of Patent: *May 23, 2023**

(54) FLARE TIP ASSEMBLY

(71) Applicant: Moneyhun Equipment Sales & Services Co., Rock Springs, WY (US)

(72) Inventors: Jesse S. Chambers, Houston, TX (US); Simon Scott Fuentes, Houston, TX (US); Jack A. Smith, Houston, TX (US); Sammie Jo Van Grinsven, Houston, TX (US); Zhili Qin, Houston, TX (US)

(73) Assignee: MONEYHUN EQUIPMENT SALES & SERVICES CO., Rock Springs, WY (US)

( * ) Notice: Subject to any disclaimer, the term of this patent is extended or adjusted under 35 U.S.C. 154(b) by 351 days.

This patent is subject to a terminal disclaimer.

(21) Appl. No.: 16/667,852

(22) Filed: Oct. 29, 2019

(65) Prior Publication Data

US 2020/0309368 A1 Oct. 1, 2020

Related U.S. Application Data

(60) Provisional application No. 62/807,819, filed on Feb. 20, 2019.

(51) Int. Cl.
*F23G 7/08* (2006.01)

(52) U.S. Cl.
CPC ..... *F23G 7/085* (2013.01); *F23G 2207/20* (2013.01); *F23G 2209/14* (2013.01)

(58) Field of Classification Search
None
See application file for complete search history.

(56) References Cited

U.S. PATENT DOCUMENTS 2,363,098 A 11/1944 Tullis
2,802,521 A 8/1957 Campbell et al.
(Continued)

FOREIGN PATENT DOCUMENTS

CA 2236224 4/1998
GB 2216250 A 2/1968
(Continued)

OTHER PUBLICATIONS

GBA Flare Systems; Flare and Vent Tips, Structures, Pilot and Ignition Systems, Ancillary Equpment; www.gba.com; 15 pages.

*Primary Examiner* — Jason Lau
(74) *Attorney, Agent, or Firm* — Thorpe North & Western, LLP

(57) ABSTRACT

A high turn down ratio flare tip assembly, that allows for both low and high flowrate and pressure flows using a single flare. The flare assembly comprising a nozzle tube connected to the waste stream fuel inlet at one end. The other end of the flare tip assembly providing a seat for a conical structure with flow through orifices/ports that allow the waste stream to flow therethrough during low pressure operation. The conical structure connected to one end of a connecting rod, the connecting rod extending longitudinally downward through the nozzle tube and connected to a spring assembly. The flare tip assembly is designed to allow low flow and pressure to pass through the cone orifices, and during high flow and pressure operation, the cone is unseated from the nozzle tube, allowing the waste stream to flow therethrough. The flare tip assembly also includes a slotted/holed shroud that allows for smokeless combustion of the waste stream during high flow and pressure conditions.

17 Claims, 18 Drawing Sheets

(56) References Cited

U.S. PATENT DOCUMENTS

| | | | | |
|---|---|---|---|---|
| 3,833,337 | A * | 9/1974 | Desty | F23G 7/08 239/DIG. 7 |
| 3,915,622 | A | 10/1975 | Desty | |
| 4,021,189 | A * | 5/1977 | Swann | F23G 7/085 431/202 |
| 5,086,982 | A * | 2/1992 | Hirano | B02C 19/066 241/40 |
| 5,975,885 | A | 11/1999 | Rajewski | |
| 6,442,771 | B1 | 9/2002 | Meier | |
| 8,800,895 | B2 | 8/2014 | Hicks et al. | |
| 9,267,686 | B1 | 2/2016 | Little et al. | |
| 9,368,806 | B2 | 6/2016 | Noh et al. | |
| 9,464,804 | B2 | 10/2016 | Tremblay et al. | |
| 9,644,356 | B1 * | 5/2017 | Gass | F16K 15/025 |
| 9,816,704 | B2 | 11/2017 | Noman et al. | |
| 2009/0117505 | A1 * | 5/2009 | Okayasu | F23D 14/60 432/221 |
| 2014/0027914 | A1 | 1/2014 | Tomizawa et al. | |
| 2014/0329186 | A1 | 11/2014 | McClain | |
| 2014/0329190 | A1 | 11/2014 | McClain et al. | |
| 2015/0050604 | A1 * | 2/2015 | Griffin | F23G 7/085 431/5 |
| 2015/0316257 | A1 | 11/2015 | Skachkov et al. | |
| 2016/0178197 | A1 * | 6/2016 | Rayssiguier | F23D 14/04 431/280 |
| 2020/0332999 | A1 | 10/2020 | Chanbers et al. | |
| 2020/0340671 | A1 | 10/2020 | Hong | |

FOREIGN PATENT DOCUMENTS

| | | |
|---|---|---|
| GB | 1459087 | 12/1976 |
| GB | 2136555 | 9/1984 |
| GB | 2216250 | 4/1989 |
| KR | 20170116950 | 10/2017 |

* cited by examiner

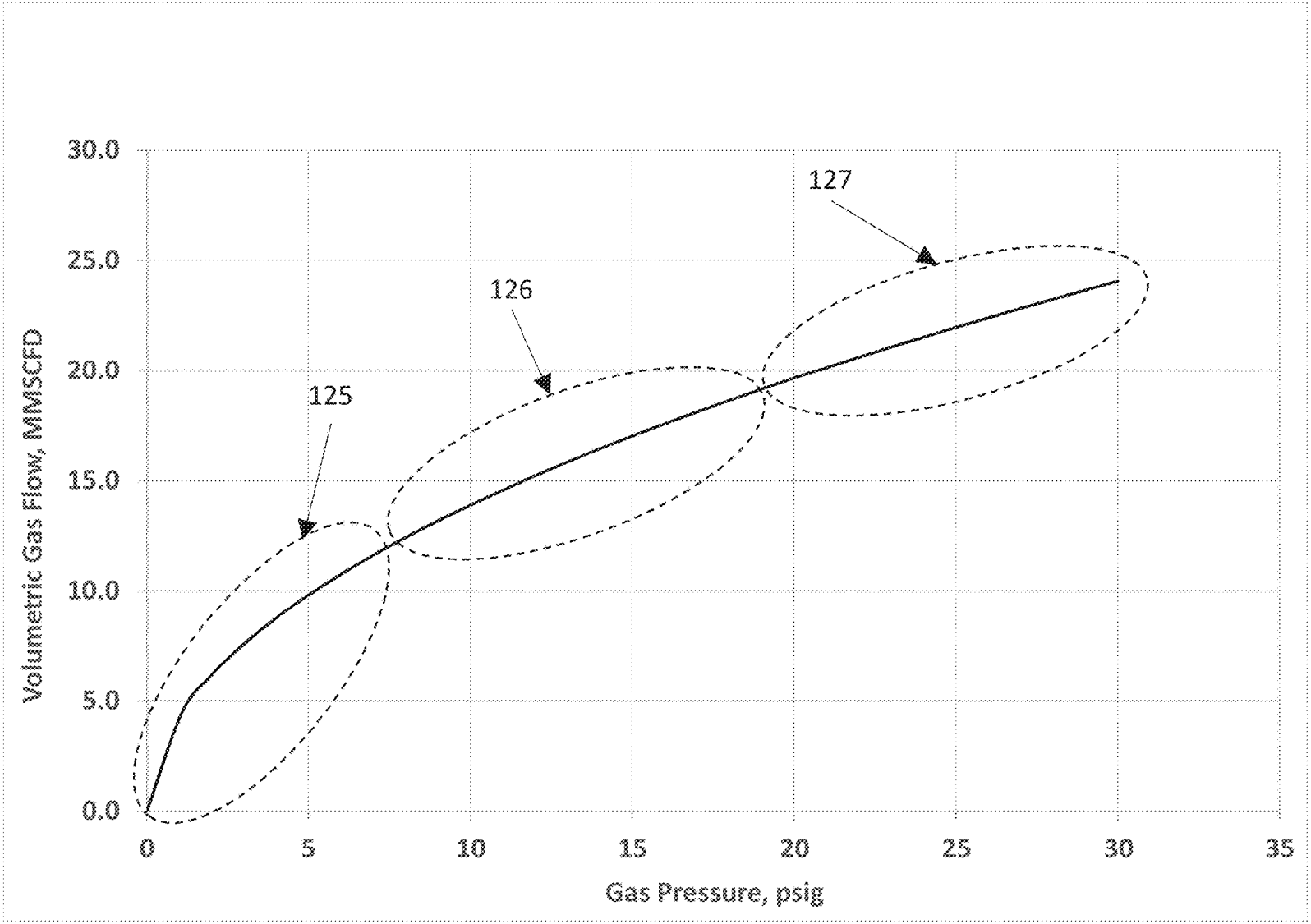
Figure 14 Flare Capacity Curve

FLARE TIP ASSEMBLY

CROSS-REFERENCE TO RELATED APPLICATIONS

This application claims the priority benefit of U.S. Provisional Patent Application Ser. No. 62/807,819 filed Feb. 20, 2019, titled "FLARE TIP ASSEMBLY," the disclosure of which is incorporated herein in its entirety.

STATEMENT REGARDING FEDERALLY SPONSORED RESEARCH OR DEVELOPMENT

Not applicable.

FIELD OF THE INVENTION

Embodiments disclosed herein relate generally to a flare tip assembly used in the combustion of gases in flare stacks for the destruction of combustible vapors in various applications, including those on oil and gas production pads, crude oil tank batteries, midstream liquified natural gas processing facilities, offshore platforms, and refining and petrochemical applications during normal and emergency operations, for efficient combustion of both low pressure vapors and high pressure vapors in a single stack, as the embodiments can safely flare both sub sonic and sonic flows.

BRIEF DESCRIPTION OF THE DRAWING

For a more complete understanding of this disclosure, reference is now made to the following brief description, taken in connection with the accompanying drawings and detailed description, wherein like reference numerals represent like parts.

FIG. 14 depicts a capacity curve for a high turndown ratio flare tip assembly in accordance with an embodiment of the present invention.

Figure 1:
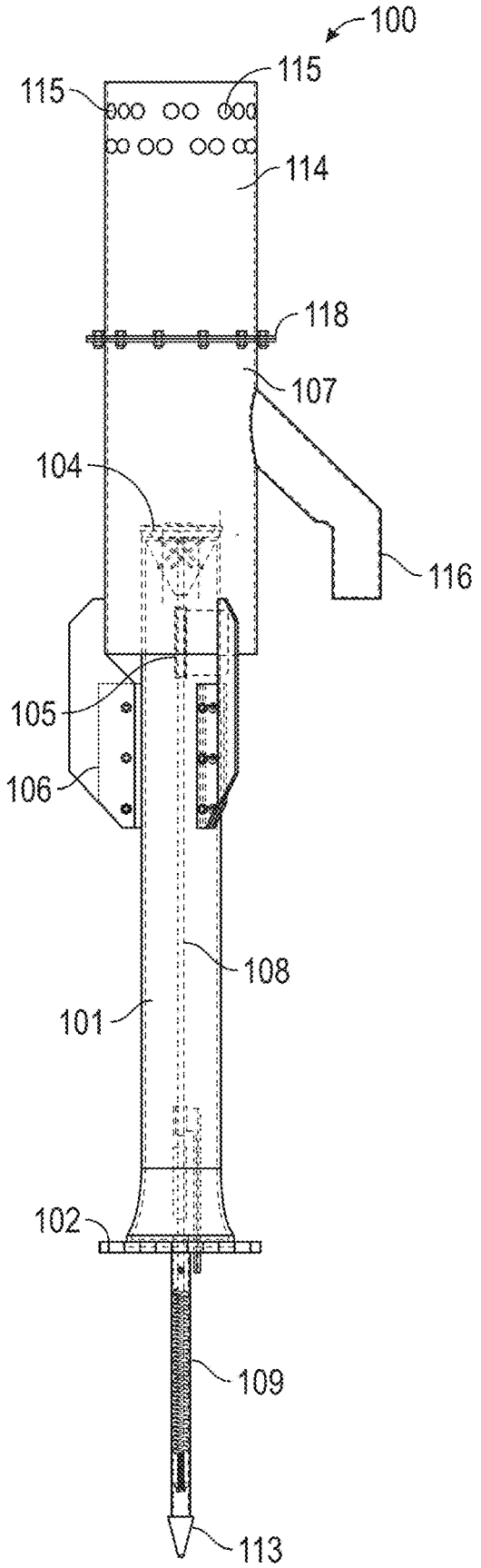
FIG. 1 depicts a flare tip assembly in accordance with an embodiment of the present invention.

While certain embodiments will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by claims. In the drawing figures, which are not to scale, the same reference numerals are used throughout the description and in the drawing figures for components and elements having the same structure, purpose or function.

DETAILED DESCRIPTION

Turning now to the detailed description of the preferred arrangement or arrangements of various embodiments of the present invention, it should be understood that, although an illustrative implementation of one or more embodiments are provided below, the inventive features and concepts may be manifested in other arrangements and that the scope of the invention is not limited to the embodiments described or illustrated. The various specific embodiments may be implemented using any number of techniques known by persons of ordinary skill in the art. The disclosure should in no way be limited to the illustrative embodiments, drawings, and/or techniques illustrated below, including the exemplary designs and implementations illustrated and described herein. The scope of the invention is intended only to be limited by the scope of the claims that follow. Furthermore, the disclosure may be modified within the scope of the appended claims along with their full scope of equivalents.

While the making and using of various embodiments of the present disclosure are discussed in detail below, it should be appreciated that the present disclosure provides many applicable inventive concepts that can be embodied in a wide variety of specific contexts. The specific embodiments discussed herein are merely illustrative of specific ways to make and use the disclosure and do not limit the scope of the disclosure.

The present disclosure will now be described more fully hereinafter with reference to the accompanying figures and drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Figure 2:
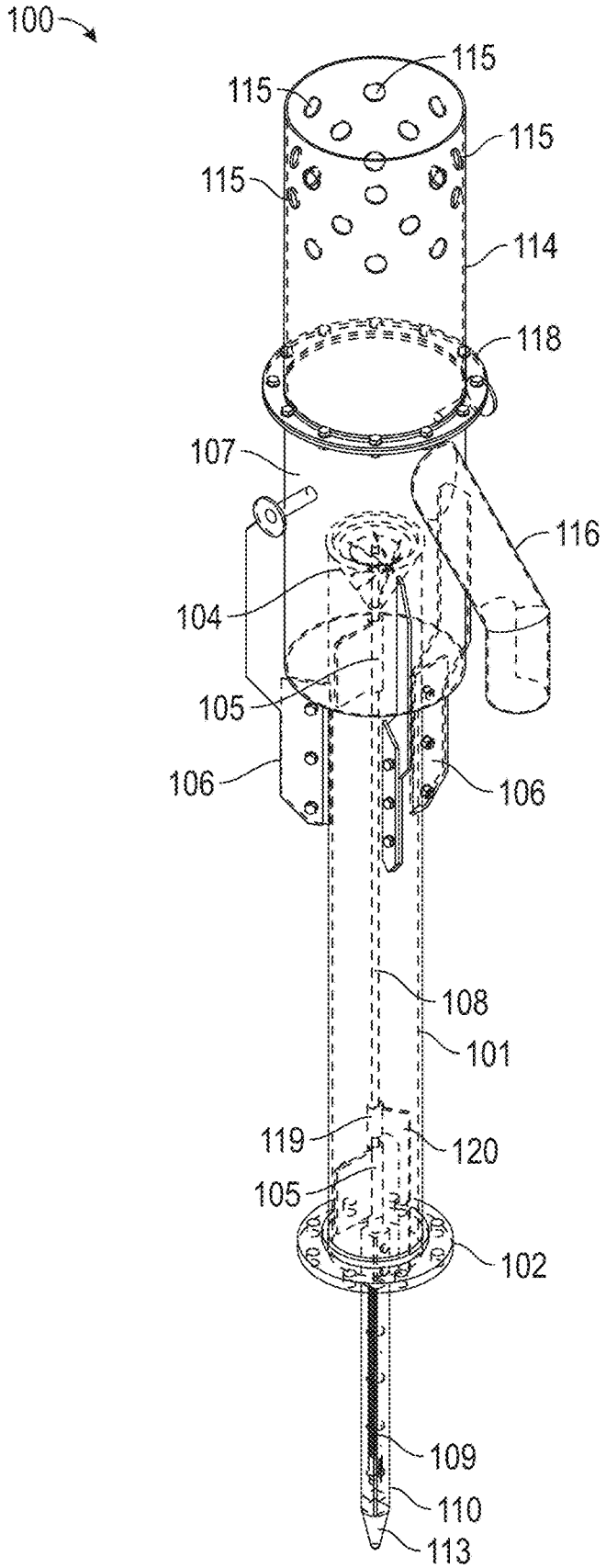
FIG. 2 depicts a flare tip assembly in accordance with an embodiment of the present invention.
Figure 3A:
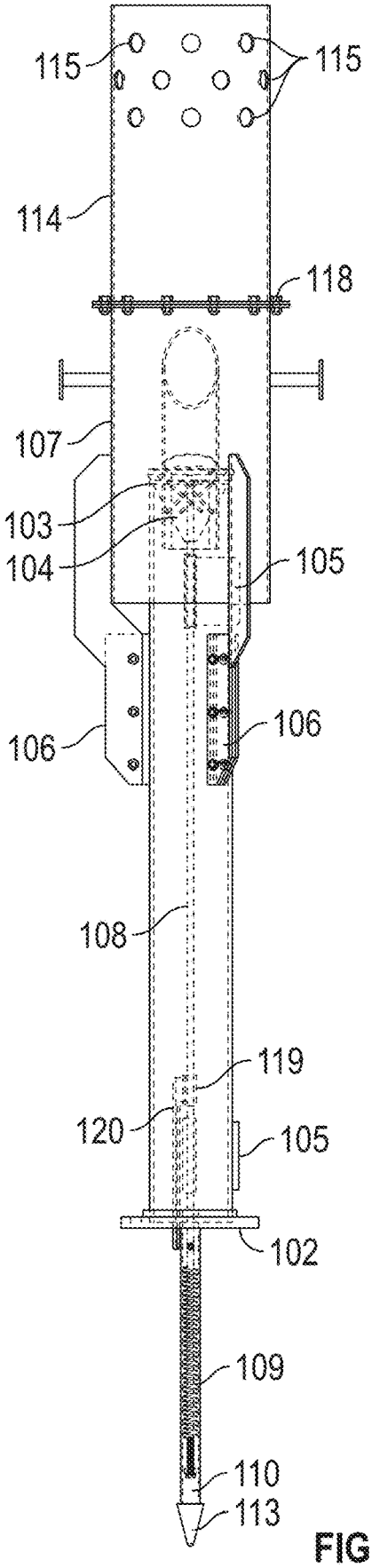
FIGS. 3A & 3B depict a flare tip assembly in accordance with an embodiment of the present invention.
Figure 3B:
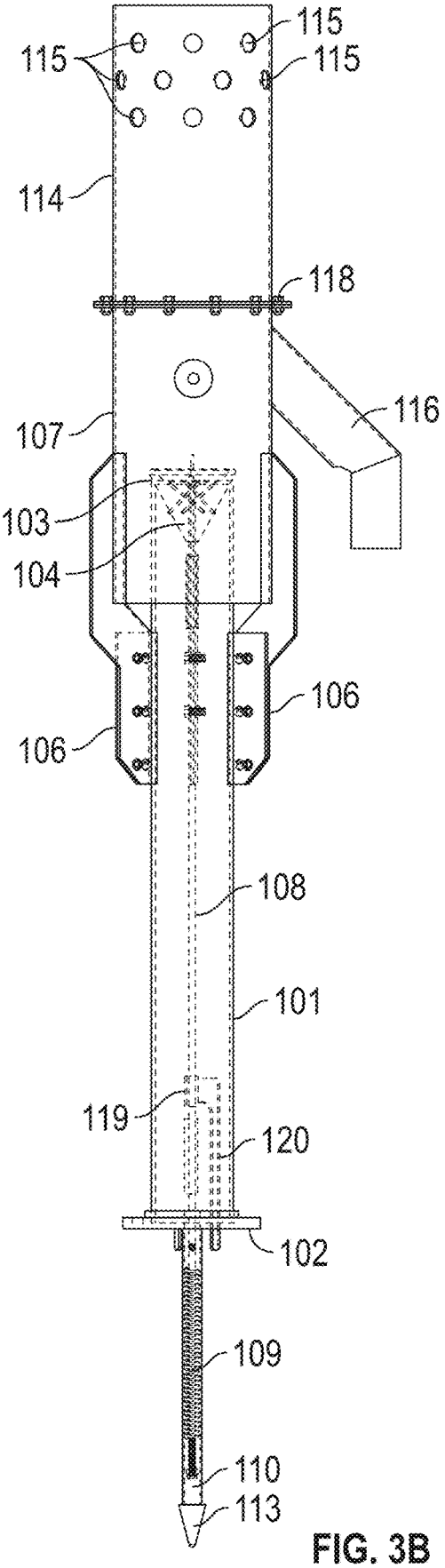
Figure 4A:
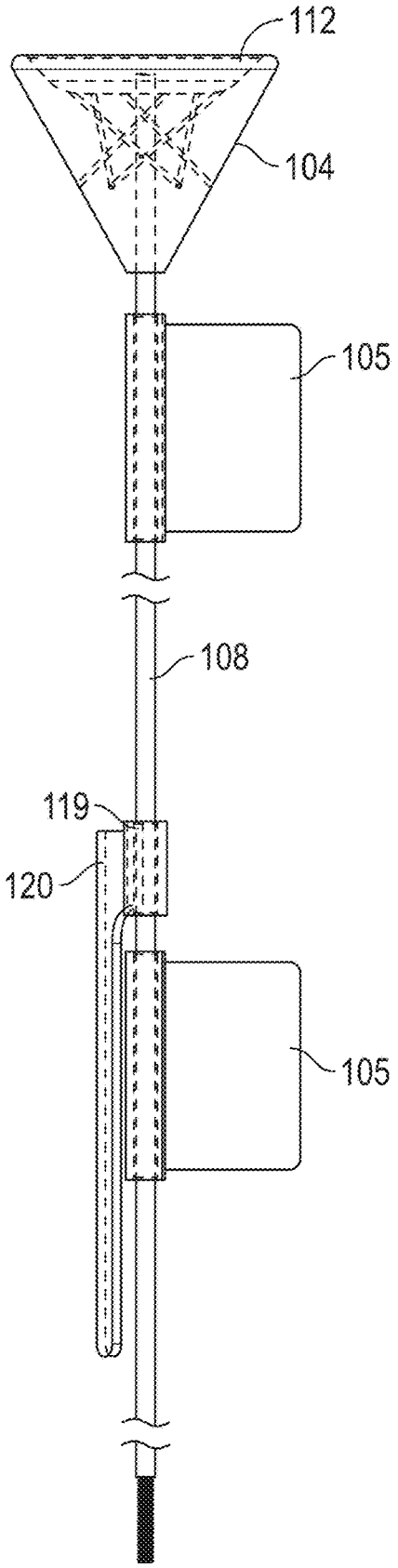
FIGS. 4A & 4B depict a portion of the flare tip assembly shown in FIGS. 1-3, in accordance with an embodiment of the present invention.
Figure 4B:
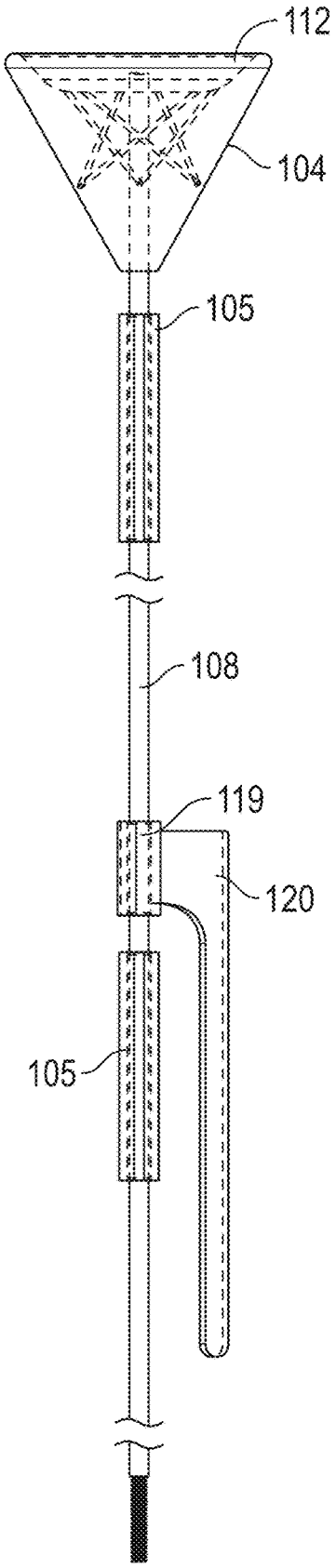
Figure 5A:
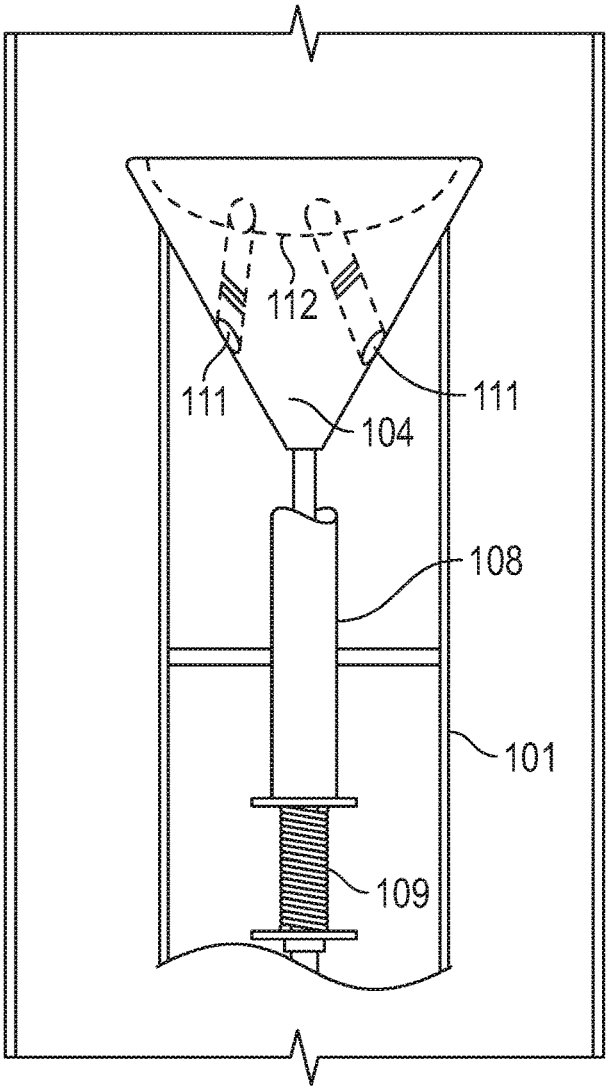
FIGS. 5A & 5B depict a flare tip assembly in accordance with an embodiment of the present invention.
Figure 5B:
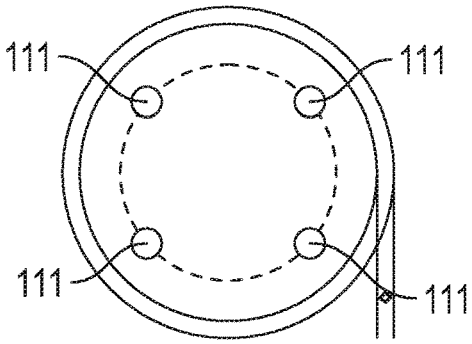
Figure 6:
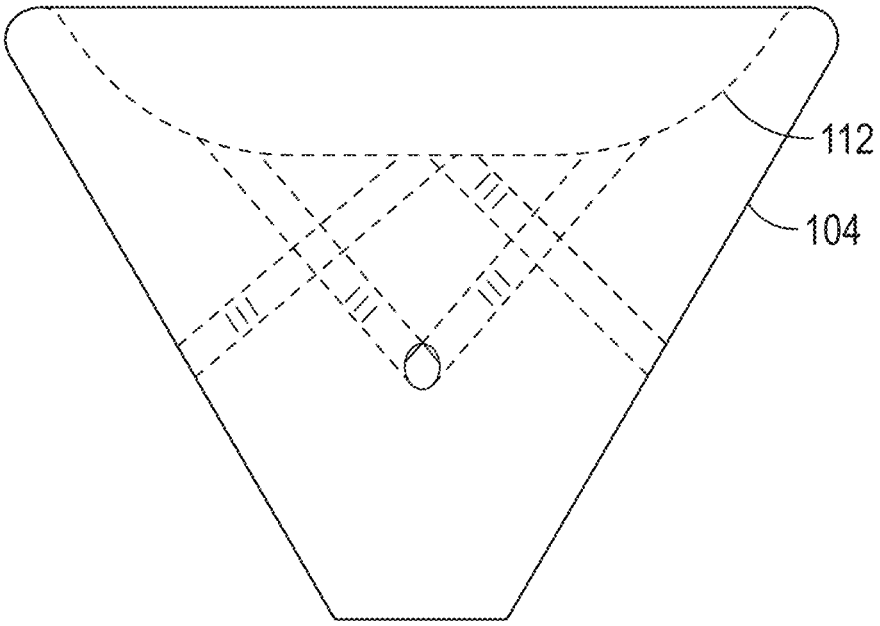
FIG. 6 depicts a cone portion of the flare tip assembly in accordance with an embodiment of the present invention.
Figure 7A:
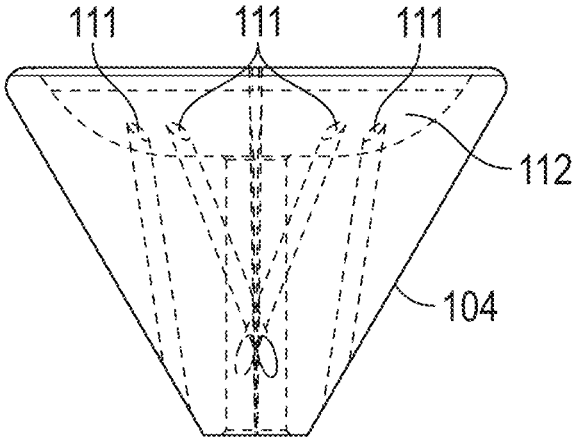
FIGS. 7A & 7B depict a cone portion of the flare tip assembly in accordance with an embodiment of the present invention.
Figure 7B:
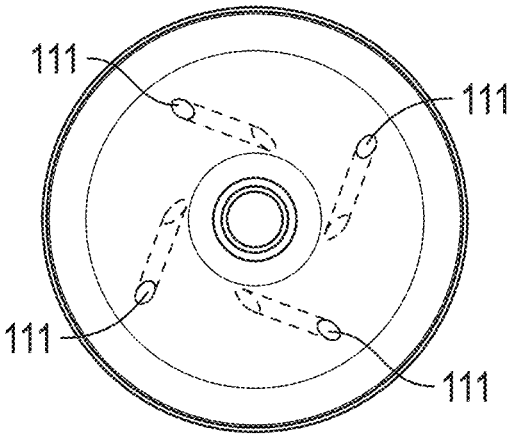
Figure 8A:
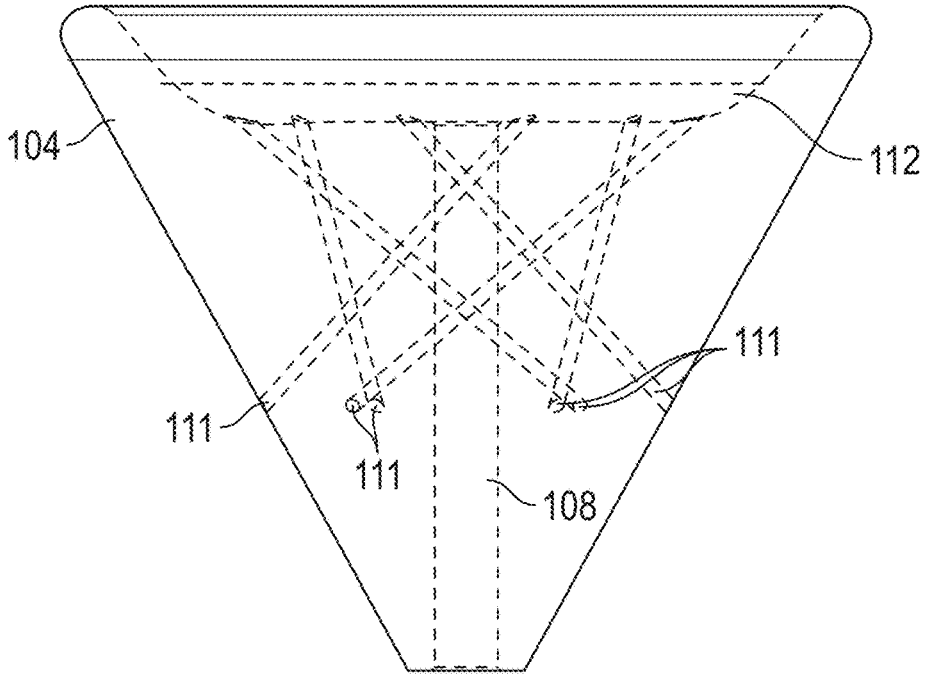
FIGS. 8A & 8B depict a cone portion of the flare tip assembly in accordance with an embodiment of the present invention.
Figure 8B:
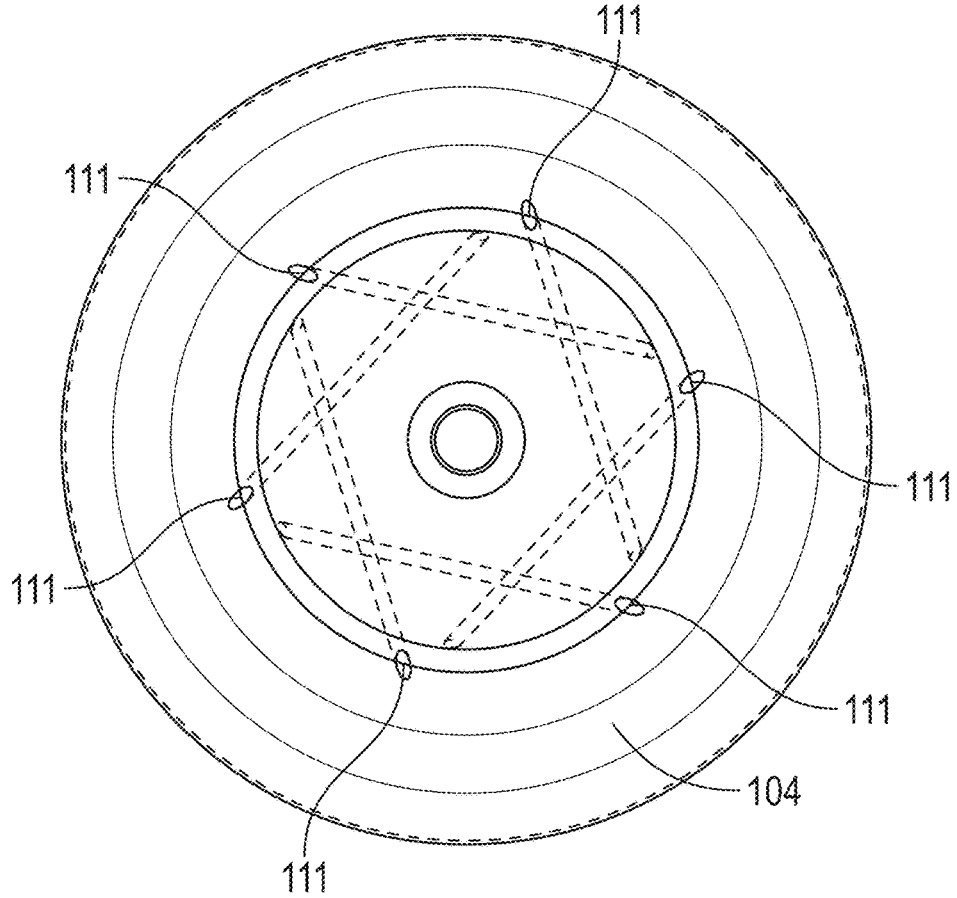

As shown in FIGS. 1-3, an embodiment of the present invention provides a flare tip assembly 100 that is capable of firing at very low rates and low pressure and firing during upset with high flow and high pressure without smoking, in order to follow federal and state regulations. The flare tip assembly 100 provides a high turndown ratio operation by adjusting the open area for gas flow automatically In one embodiment of the present invention, the flare tip assembly 100 is mounted on the top of new or existing flare stacks (not shown) and utilizes the various pressures of the waste stream to adjust the open area for proper fuel and air mixing.

Figure 9A:
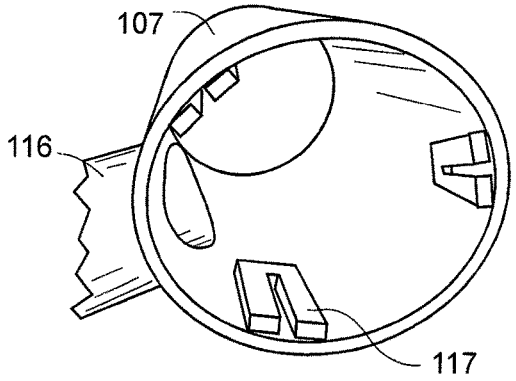
FIGS. 9A to 9E depict partial perspective views of a flare tip assembly in accordance with an embodiment of the present invention.
Figure 9B:
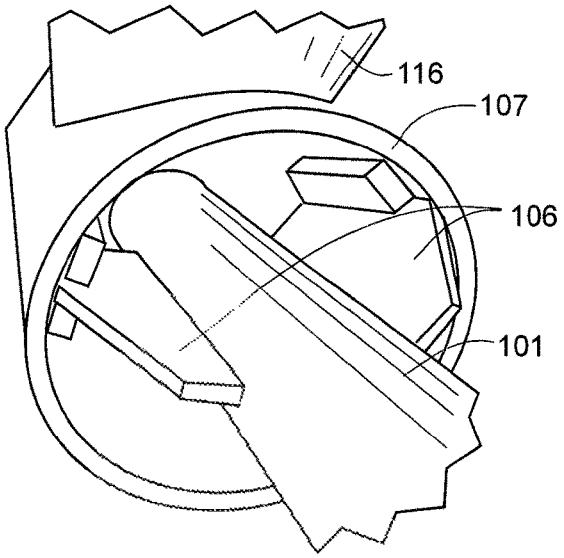
Figure 9C:
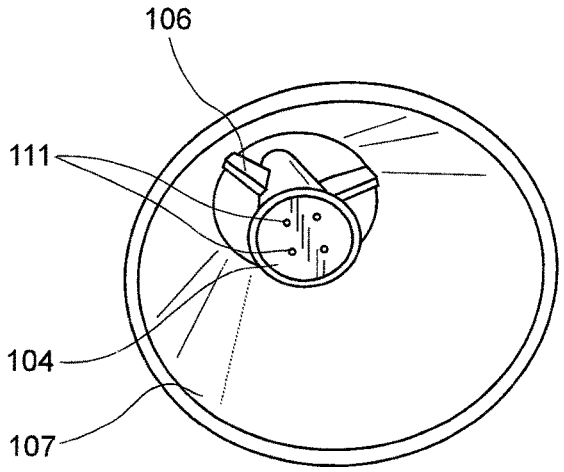
Figure 9D:
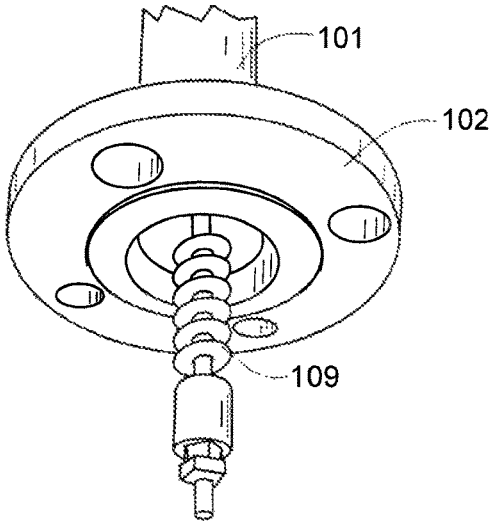
Figure 9E:
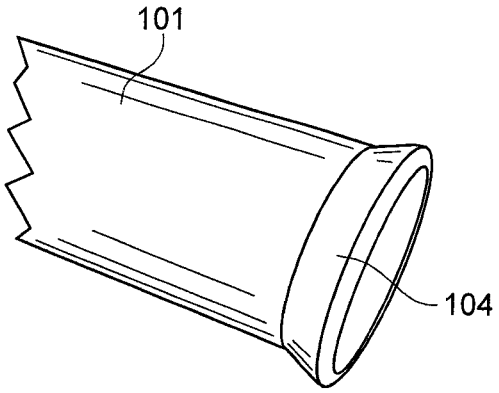
Figure 10:
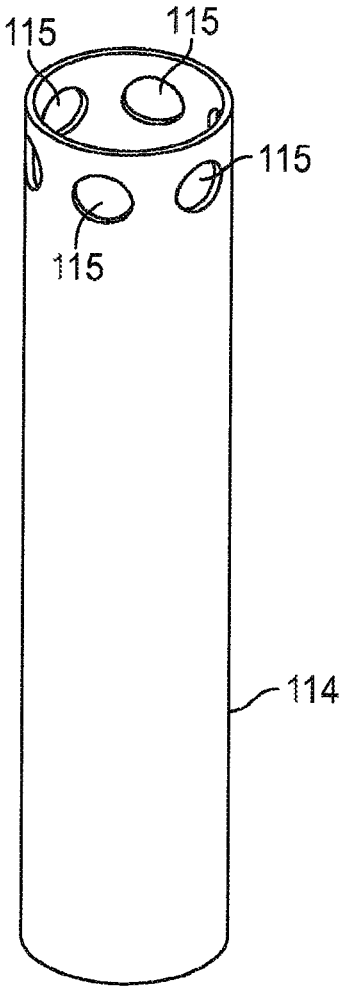
FIG. 10 depicts a shroud portion in accordance with an embodiment of the present invention.
Figure 11:
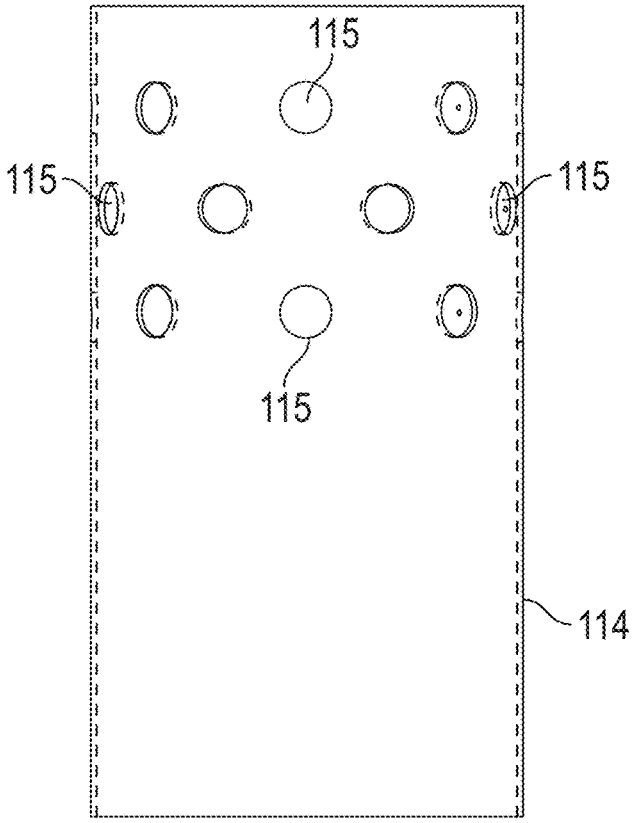
FIG. 11 depicts a shroud portion in accordance with an embodiment of the present invention.
Figure 12:
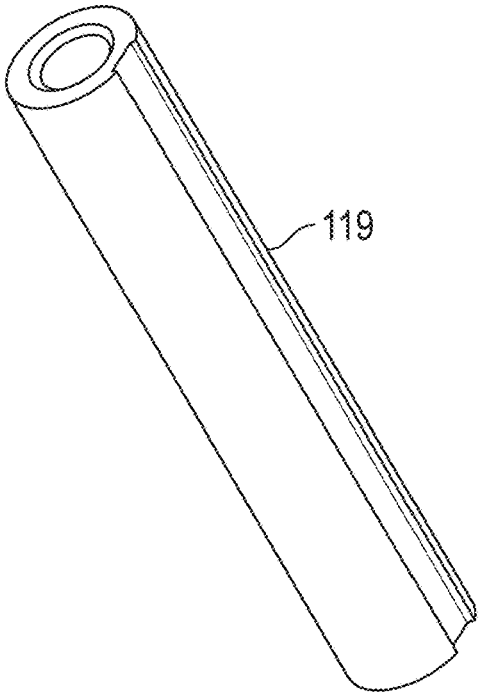
FIG. 12 depicts an anti-rotation slotted guide 119 as shown in FIGS. 2-4, in accordance with an embodiment of the present invention.

As shown in FIGS. 1-5, a flare tip assembly 100 according to an embodiment of the invention is provided for the combustion of vapors in a flare system. The flare tip assembly 100 is designed to safely and efficiently burn vapors, including hydrocarbon bearing waste and vent streams. The flare tip assembly 100 includes a nozzle tube 101 such as a machined pipe tapered on top to fit a machined cone 104 with a diameter based on flow area needed. This nozzle tube 101 is fitted for example with a flanged connection 102 (see e.g., FIG. 9D) or other suitable connection for mounting to an elevated flare stack (not shown). Opposite the flanged end 102 is a machined chamfered end 103 that is angled to allow the seating and sealing of the cone 104 in low pressure operations and to optimize waste and vent stream vapor flow. For example, the machined chamfered end 103 is can be angled between 15° and 80°, such as 30°, 45°, 60° and 75°, and other angles that can be used to optimize waste and vent stream vapor flow.

The nozzle tube 101 can include machined slots (not shown), spaced along the length of the nozzle tube 101 for attaching centering guides 105. Within the nozzle tube 101 there is a connecting rod 108 that extends within the nozzle tube 101 along the nozzle tube 101's longitudinal axis. The connecting rod 108 passes through the centering guides 105 installed in the nozzle tube 101 and extends into the spring assembly 109. The connecting rod 108 also extends through an anti-rotation slotted guide 119 (FIGS. 2, 3, 4 and 12) that is connected to a rotation stop rung 120. In one embodiment the spring assembly 109 sets below the flanged end 102 of the nozzle tube 101, which takes the spring assembly 109 below the flare's active flame, making it readily serviceable. See e.g., FIG. 9D. In another embodiment (not shown), the spring assembly 109 is located above the flanged end 102. In another embodiment, a spring connection tube 110 encloses the spring assembly 109. In a further aspect of this embodiment, at one end of the spring connection tube 110 a cap 113 is attached to the spring connection tube 110. The type, design and material of spring assembly 109 can be the same or different depending on the flare tip design and gas stream properties. In one embodiment, single or multiple compression springs are used in the spring assembly 109. See e.g., FIG. 5A. In another embodiment, a stack of disc springs is used to achieve the desired function. See e.g., FIG. 9D. In another embodiment (not shown), the spring assembly 109, connection tube 110 and cap 113 are removed and the gravity force of the cone 104 and connecting rod 108 can still achieve the design functions.

At the end of the connecting rod 108 that is opposite to the spring assembly 109, a cone shaped structure 104 is connected to the connecting rod 108. In one embodiment, the cone 104 is attached to the connecting rod 108 by welding a substantially flat shaped cone 104 bottom to the connecting rod 108, which is attached at the bottom center of the cone 104. In other embodiments, the cone 104 is integrally formed with the connecting rod 108, or the cone 104 is connected to the connecting rod 108 using a threaded connector, or the cone 104 is connected to the connecting rod 108 using a pinned connection, or the connecting rod 108 extends up through the cone 104 and is connected to the bottom of a concaved section 112 of the cone 104 body, or any combination thereof and the like. See e.g., FIGS. 3-8.

The cone 104 is preferably a machined cone with a concave top 112 having a taper with a cone angle of between 15° and 80°, such as 30°, 45°, 60°, 75° and other angles, from the top to the bottom. See e.g., FIG. 6. The cone 104 can be manufactured by many means such as casting, fabricated with tubes welded therein, 3-D printing or any other appropriate manufacturing methods. Sizing of the cone 104 is designed based on diameter of nozzle tube 101 and desirable flowrates at various inlet pressure. The transition from the concave top 112 to the taper is a rounded edge. In one embodiment of the present invention the cone has rounded smooth edges, which enhance the and help maintain a controlled frame profile. In a further aspect of any embodiment of the present invention, the cone tip diameter is sized to achieve designed flow across a wide range of capacities, and include cone diameters of 2-inch, 3-inch, 4-inch, 6-inch and 8-inch.

In one embodiment, the cone 104 is designed such that the tapered end sits within a seat formed by the chamfered end 103 of the nozzle tube 101. See e.g., FIGS. 3, 5A, 9C, 9E, 13D. In one embodiment, the cone 104 includes tubular firing orifices 111 drilled from the bottom of the concaved top 112 through the cone 104 body and exiting along an outer surface of the cone 104. The diameter, angle of attack, and total amount of firing orifices 111 are configured based on flowrate and size of the flare tip assembly 100, to optimize fuel gas dispersion and air/fuel mixing. In one embodiment, the diameter of firing orifices 111 changes between 1/16 in and 1/2 in, including 1/8 in, 3/16 in, 1/4 in, 3/8 in, and other sizes. In one embodiment, the total amount of firing orifices 111 changes between 2 and 12, including 4 (FIG. 5A, 7, 9C), 6 (FIG. 4, 8), 8, 10, and other numbers. In a further aspect of an embodiment, the firing orifices 111 are drilled from the bottom of concaved top 112 through the cone 104 body and preferably exit at approximately half the height of the cone 104. See e.g., FIGS. 3-8, 9C. In another aspect of an embodiment, the orifices 111 are preferred to be axisymmetric and tangential to the cone 104. See e.g., FIGS. 3-8, 9C.

In an embodiment of the present invention, the cone 104 and tubular firing orifices 111 are configured to minimize the use of purge gas and/or velocity reduction devices in order to prevent bum back inside the nozzle tube 101 and flare stack (not shown). For example, in an embodiment of the present invention, no or minimum purge gas is required. In an embodiment of the present invention, the tip design minimizes and or does away with the need of purge gas and/or velocity seals used to prevent the back flow of combustible gases back into the nozzle tube 101 and flare stack (not shown) during low fire conditions, For example, in one embodiment this is achieved due to the cone 104 shape with the concave top 112, with a cone 104 angle of between 15° and 80°, along with the multiple tangential tubular orifices 111 that pass through the cone 104 body starting in the concave face 112 and passing through the cone 104 at an angle. See e.g., FIGS. 3-8, 9C. The combination of these firing orifices 111 and the sealing of the cone 104 to the chamfered end 103 at low flowrate, means that the flow must pass through the firing orifices 111 where in one embodiment, by size and position they achieve a length over diameter of greater than two, which can help prevent the propagation of the flame front back through the firing orifices 111 even at very low pressures.

Around the perimeter of the nozzle tube 101 there are gusset halves 106 for lower shroud 107 mounting. See e.g., FIGS. 1-3, 9B. In one embodiment, the shroud assembly can include two parts-the upper 114 and lower shroud 107. In one embodiment, the shrouds 107, 114 are tubular. In another embodiment, the shrouds 107, 114 are approximately twice or three times the diameter of the nozzle tube 101. In one embodiment, the lower shroud 107 is positioned with mounting gussets 117 so that nozzle tube 101 is placed at the center of lower shroud 107 and the bottom of lower shroud 107 is approximately twelve to twenty-four inches below the exit of the nozzle tube 101. See e.g., FIGS. 3-8, 9A, 9B. The mounting gussets 106 can be outside of lower shroud 107 as in FIG. 1-3 or inside as in FIGS. 9A and 9B. The lower shroud 107 also contains the pilot hood 116 extending from its side at a 45°-degree angle. The pilot hood 116 allows for the pilot flame to intersect the fuel exit area between the nozzle tube 101 and cone 104. See e.g., FIGS. 13A-13D. This covered pilot design prevents excessive wear and damage of the pilot assembly. The upper shroud 114 is attached to the top of the lower shroud 107 with mating flanges 118 and extends upwards some distance. In one embodiment, the distance or height of the upper shroud 114 is based on flow rate and flare size. For example, to address the issue of the flame being affected by wind and to help induce more efficient mixing, in one embodiment of the present invention a larger/longer shroud 114 can be used, for example going from a 12" shroud height to 36" shroud height. In one embodiment of invention, using a shroud 114 having a larger length over diameter (LID) ratio provides better fuel and air mixing, which allows for more stable combustion before the mixture is dispersed by wind. Exemplar features of various flare tip embodiments of the present invention are shown below in Table 1.

TABLE 1

| . | Cone TIP Size | Cone Angle | Shroud Height | Number of Orifices | Shroud L/D | Orifice Diameter | Orifice Angle of Attack |
|---|---|---|---|---|---|---|---|
| HTDR-Mini | 2" | 15° to 80° | 25' | 4 to 10 | 3 to 6 | 1/16" to 1/2" | 30° to 60° |
| HTDR-1 | 3" | 15° to 80° | 35' | 4 to 10 | 3 to 6 | 1/16" to 1/2" | 30° to 60° |
| HTDR-2 | 4" | 15° to 80° | 45' | 4 to 10 | 3 to 6 | 1/16" to 1/2" | 30° to 60° |
| HTDR-3 | 6" | 15° to 80° | 65' | 4 to 10 | 3 to 6 | 1/16" to 1/2" | 30° to 60° |
| HTDR-4 | 8" | 15° to 80° | 85' | 4 to 10 | 3 to 6 | 1/16" to 1/2" | 30° to 60° |

In one embodiment, there are a number of spaced openings 115 around the perimeter of the top of the upper shroud 114. See e.g., FIGS. 1-3, 10, 11. In a further aspect of this embodiment, the upper shroud 114 includes equally spaced openings 115 around the perimeter of the top of the upper shroud 114. The spacing and total numbers of spaced openings 115 varies depending on flare size. The design of the upper shroud 114 with spaced openings 115 not only enhances stability of the flame front but helps to negate some of the effects of crosswinds. In one embodiment, the upper shroud 114 includes multiple rows of spaced openings 115. In this embodiment, during for example high fire situations, the multiple rows of spaced openings 115 allow more air to be induced in the mixture allowing for complete combustion, thus promoting smokeless performance.

The shape of the tapered cone 104 with a concave top 112, and use of the tangential firing orifices 111, and use of upper shroud 114 with openings 115, aid to induce a vortex flow which creates more turbulence when mixing the fuel stream with the annular air flow between the nozzle tube 101 and lower shroud 107, thus allow for a stable flame attachment in both low and high pressure flow conditions, providing a high turndown ratio configuration, See e.g., FIGS. 1-3, 10, 11. In a further aspect of an embodiment of the present invention, the cone 104 design directs fuel flow outward at a predetermined angle for optimized mixing and interaction with the shroud 107, 114, which creates a unique and efficient flow pattern that is carried throughout the flare firing range resulting in a stable, smokeless operation.

In one embodiment, during normal low-pressure operation the fuel, such as a hydrocarbon-based waste stream, is introduced to the fuel inlet on the base of an elevated flare stack (not shown) and will travel up through the stack and exit out of the nozzle tube 101/cone 104 assembly. In one embodiment, if this is a low-pressure stream, for example less than one pound per square inch gauge (PSIG) pressure, the cone 104 is completely seated at the chamfered end 103 of nozzle tube 101, with the fuel stream only passing through the firing orifices 111. This low-pressure flow is ignited as it exits the firing orifices 111 by the pilot and the concave top 112 of the cone 104 is designed to further create a low-pressure zone of recirculation to maintain stability. Air is drawn into the bottom of the lower shroud 107 in a low-pressure case as the result of a draft created from heating the air inside the shroud 107. In one embodiment, the spring assembly 109 is configured allow cone 104 to move upward and unseat from the chamfered end 103 of nozzle tube 101 as the pressure is increased inside the nozzle tube 101. See e.g., FIGS. 1-3, 9D. In this embodiment, cone 104 will begin move upward creating an annular orifice around the perimeter of the cone 104 and the exit of the nozzle tube 101, while also applying some tension to the spring assembly 109. Fuel gas stream now exits through both the annular orifice mentioned above and the firing orifices 111. Once the pressure exceeds a predetermined value, for example approximately eight PSIG, the cone 104 is fully extended and the effective annular orifice open area is equal to the open area of the nozzle tube 101. As the cone 104 begins to rise the pressure of the fuel gas will begin to create a venturi effect at the air inlet to the shroud 107 pulling a certain percentage of the needed combustion air into the shroud 107 and 114, thus creating a partial premix condition. The partial premix in conjunction with the variable annular orifice between tapered surface of cone 104 and chamfered end 103 of nozzle tube 101, firing orifices 111 and shroud 107, 114 allow better fuel dispersion and fuel/air mixing, creating a very stable smokeless operation across a wide range of fuel gas pressure.

Figure 13A:
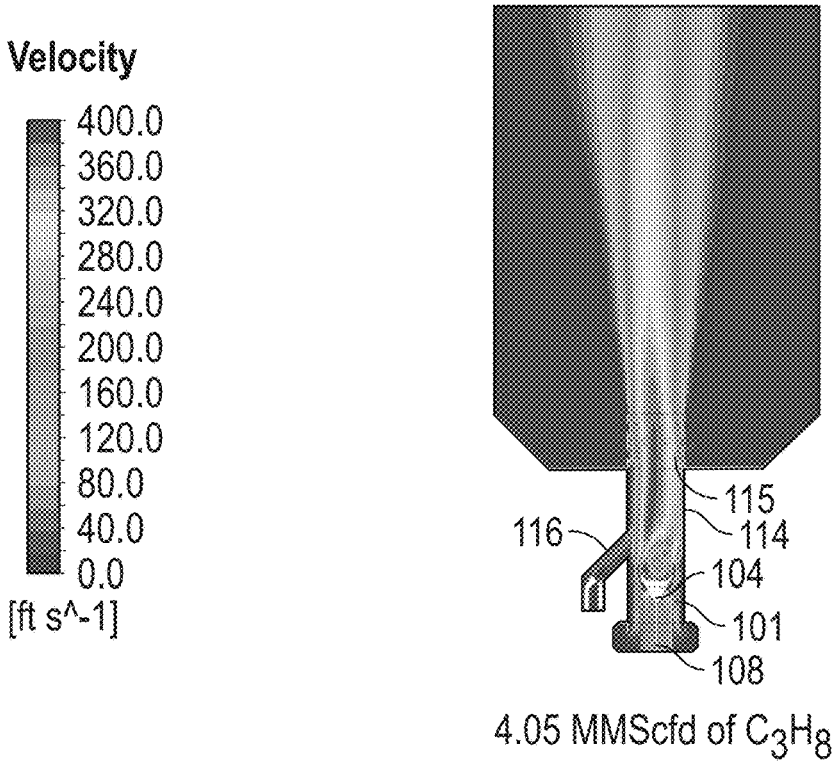
FIGS. 13A-13D depict flow profiles using a flare tip assembly in accordance with an embodiment of the present invention.
Figure 13B:
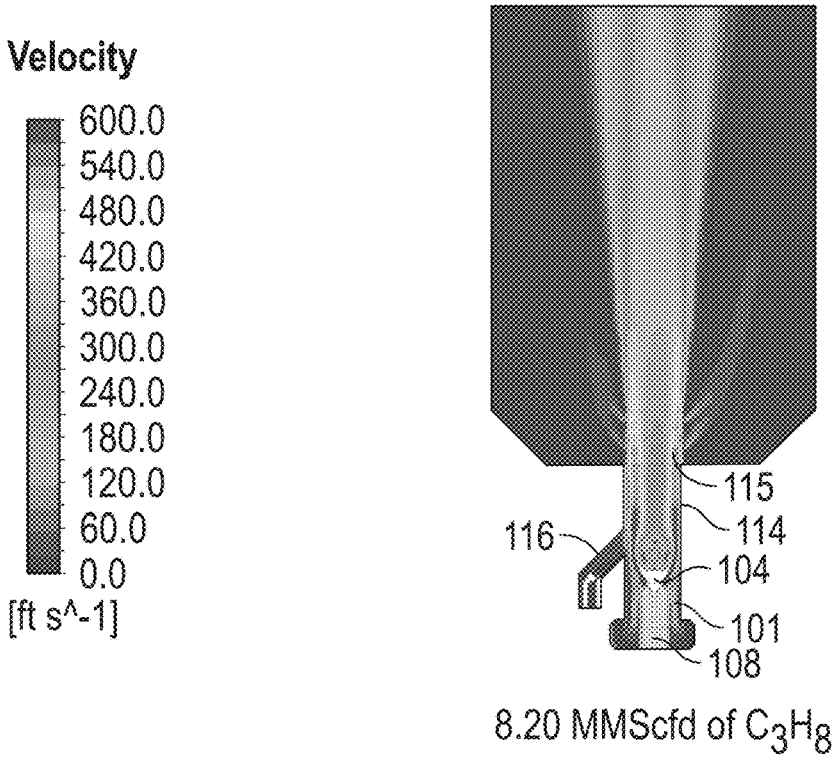
Figure 13C:
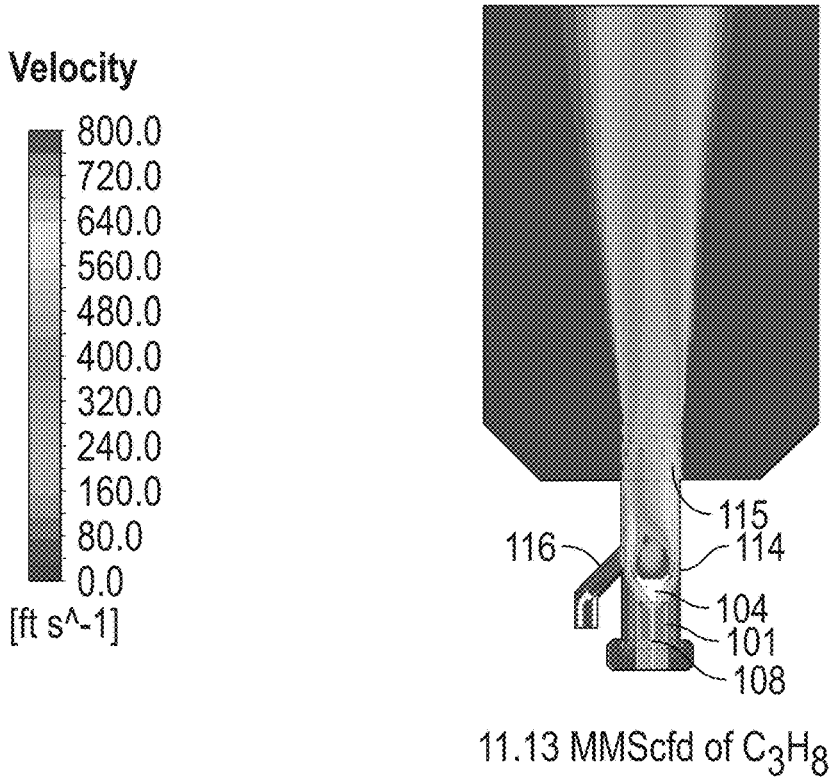
Figure 13D:
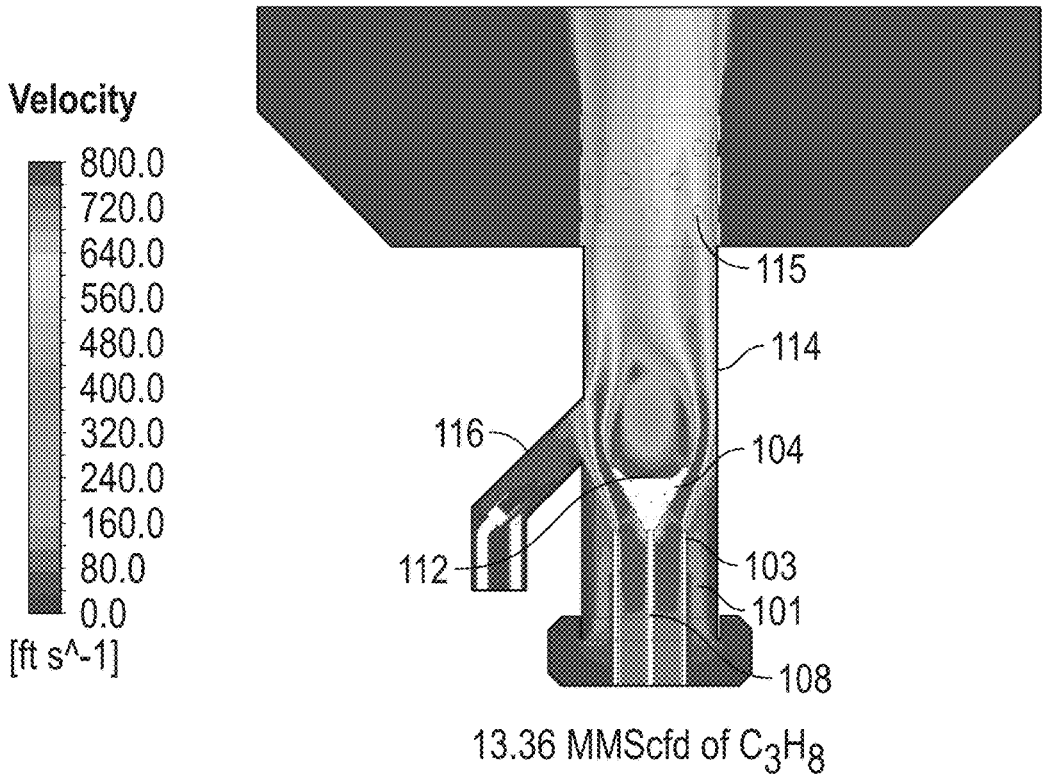

Referring to FIGS. 13A-13D, depicted are example flow contours that depict the flow of $C_3H_8$ (propane) in millions of standard cubic feet per day (MMSCFD) through a flare tip assembly embodiment of the present invention and travel of the cone 104 away and unseated from the nozzle tube 101 as the flow rate is increased. These flow contours are calculated by using advanced Computational Fluid Dynamics (CFD) simulation. As depicted the $C_3H_8$ flow rate increases respectively in FIGS. 13A-13D. And as the flow increase, for example, 4.05 MMSCFD in FIG. 13A and 13.36 MMSCFD in FIG. 13D, the cone 104 is completely unseated in FIG. 13D as compared to the location of the cone 104 within the nozzle tube 101 as depicted in FIGS. 13A-13C. As also depicted, the flow is substantially uniform.

Above certain fuel pressure which is enough to overcome the spring tension and gravitational force of cone 104, rod 108 and spring assembly 109, the cone 104 tip will lift up creating more open area for the gas flow. The lifting distance of cone 104 is related to fuel pressure allowing for a design that adjusts the open area for various conditions while also being capable of firing variable range of fuels compositions. The flare tip assembly 100 is designed so that the cone 104 will start to lift and rise until full open within an appropriate gas pressure range, achieving better fuel/air mixing and also preventing high upstream back pressure. To create more tension in order to keep the cone 104 tip from becoming fully open at a low pressure stiffer springs should be used in the system. For example, in an embodiment of the present invention, six (6) polywave springs can be used for the spring assembly 109. For example, during testing, using six (6) polywave springs, the system became fully open at about 4-5 PSIG. In a further aspect of an embodiment of the present invention, the configuration of the spring assembly 109, and cone 104 design yield a larger turndown capability, keeping the fuel gas exit velocity within the design range by preventing the system from opening fully too early. The spring assembly 109 is designed to have a spacer (not shown) that will allow variable tension loading to add more flexibility.

In one embodiment, this apparatus, when mounted on an elevated flare stack (not shown) facilitates the mixing of fuel and air across a wide range of fuel pressures, allowing for the efficient combustion of the fuel stream, with ninety-eight percent (98%) or higher destruction efficiency and with no visible smoke. In a further aspect of an embodiment of the present invention, the flare tip assembly 100 including cone 104, firing orifices 111, spring assembly 109 and shroud 114 with openings 115 is designed based on the maximum flow rate that is required and the maximum available gas pressure, while maintaining acceptable gas velocity at exit of shroud 114.

In one embodiment of the present invention, the flare tip assembly 100 provides a greater than 200 to 1 turndown ratio of the flare. In a further aspect of an embodiment of the present invention, the cone 104 geometry design and inclusion of firing orifices 111 allows for accommodating low and high-pressure vent gas eliminating the need for multiple flares (e.g., a low-pressure flare assembly and a high-pressure flare assembly). See e.g., FIG. 14. For example, as shown in FIG. 14, a flare capacity curve for a flare tip assembly in accordance with an embodiment of the present invention shows that the single flare tip assembly can operate at a pressure range of 0 to 30 psig with a volumetric gas flow of 0 to approximately 24 MMSCFD, as opposed to requiring multiple flare assemblies to operate over this range. Moreover, the single flare tip assembly of an embodiment of the present invention can operate over this range while meeting emission requirements. For example, a small traditional flare would operate in the curve 125 region, a medium traditional flare would operate in the 126 region, and a large traditional flare would operate in the 127 region.

Figure 15:
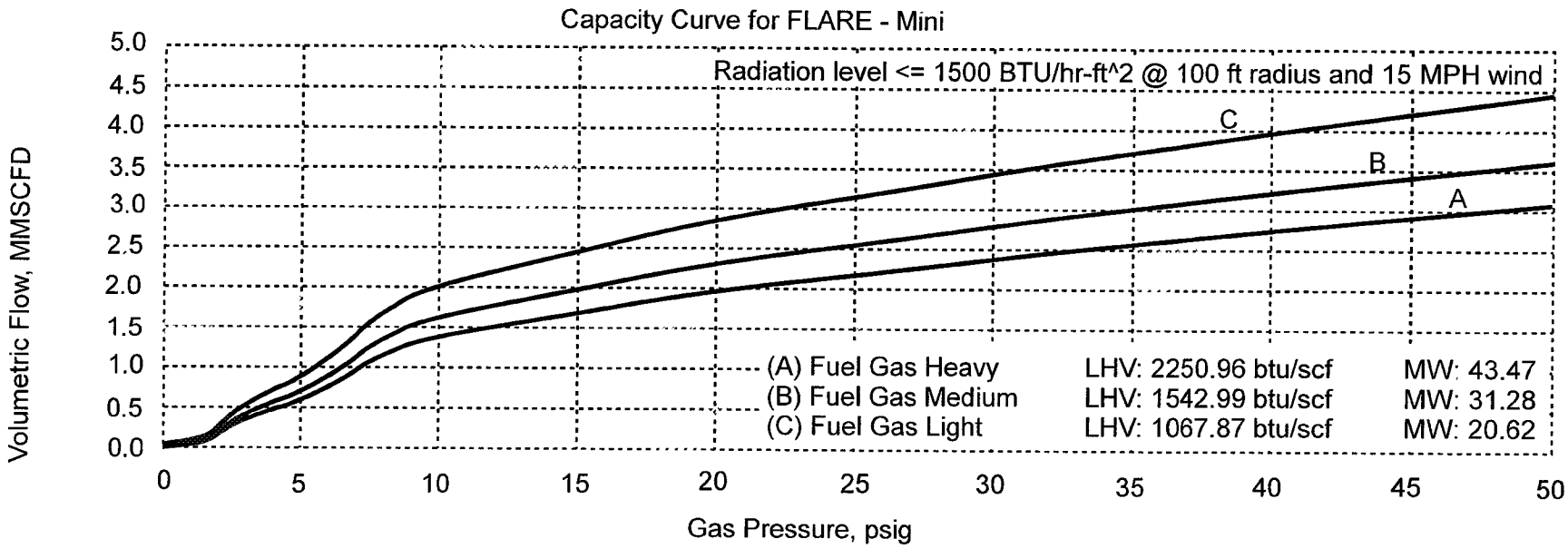
FIGS. 15 to 19 depict example flare capacity curves for various single flare tip assemblies in embodiments of the present invention.

Further examples of flare capacity curves for various single flare tip assemblies in accordance with an embodiment of the present invention are shown in FIGS. 15-19. As shown in FIGS. 15-19, curve A represents a light fuel gas having a lower heating value (LHV) of 1067.87 btu/scf and a molecular weight (MW) of 20.62, curve B represents the a medium fuel gas having a lower heating v alue (LHV) of 1542.99 btu/scf and a molecular weight (MW) of 31.28, and curve C represents a heavy fuel gas having a lower heating value (LHV) of 2250.96 btu/scf and molecular weight (MW) of 43.47. For example, as shown in FIG. 15, the Flare-Mini flare tip assembly in accordance with an embodiment of the present invention can operate at a pressure range of 0 to 50 psig with a volumetric gas flow of 0 to approximately 4.4 MMSCFD for a light fuel gas.

Figure 16:
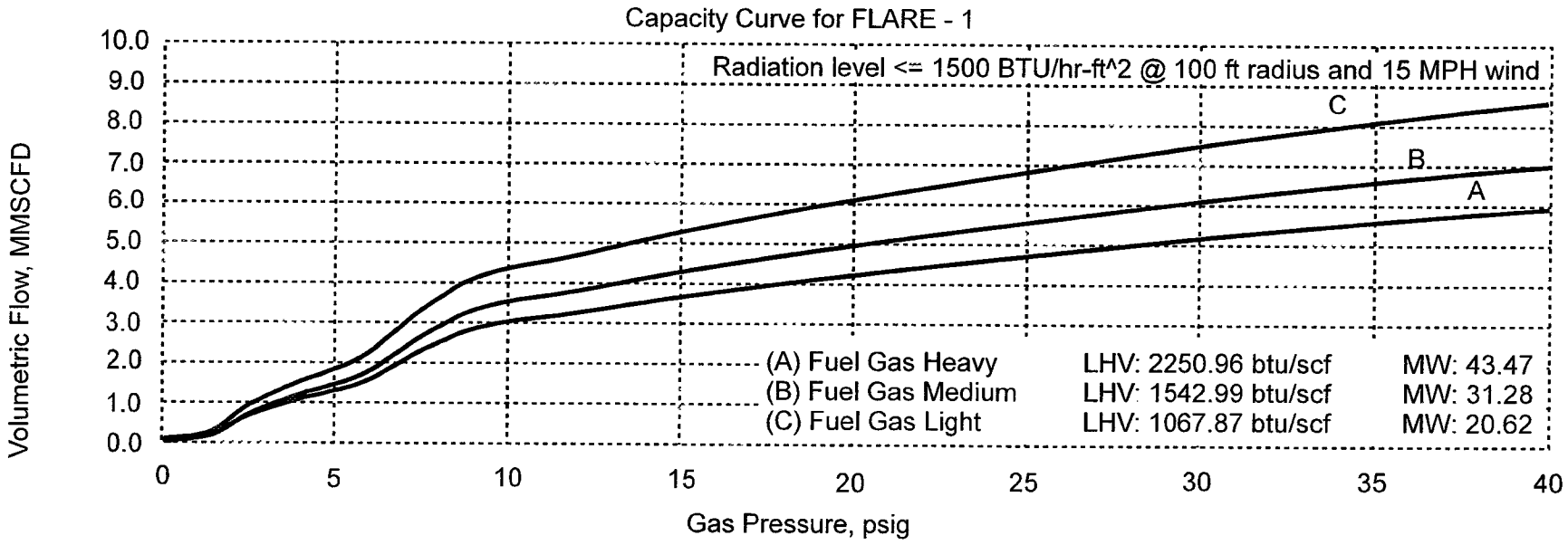

As shown in FIG. 16, the FLARE-1 flare tip assembly in accordance with an embodiment of the present invention can operate at a pressure range of 0 to 40 psig with a volumetric gas flow of 0 to approximately 8.8 MMSCFD for a light fuel gas.

Figure 17:
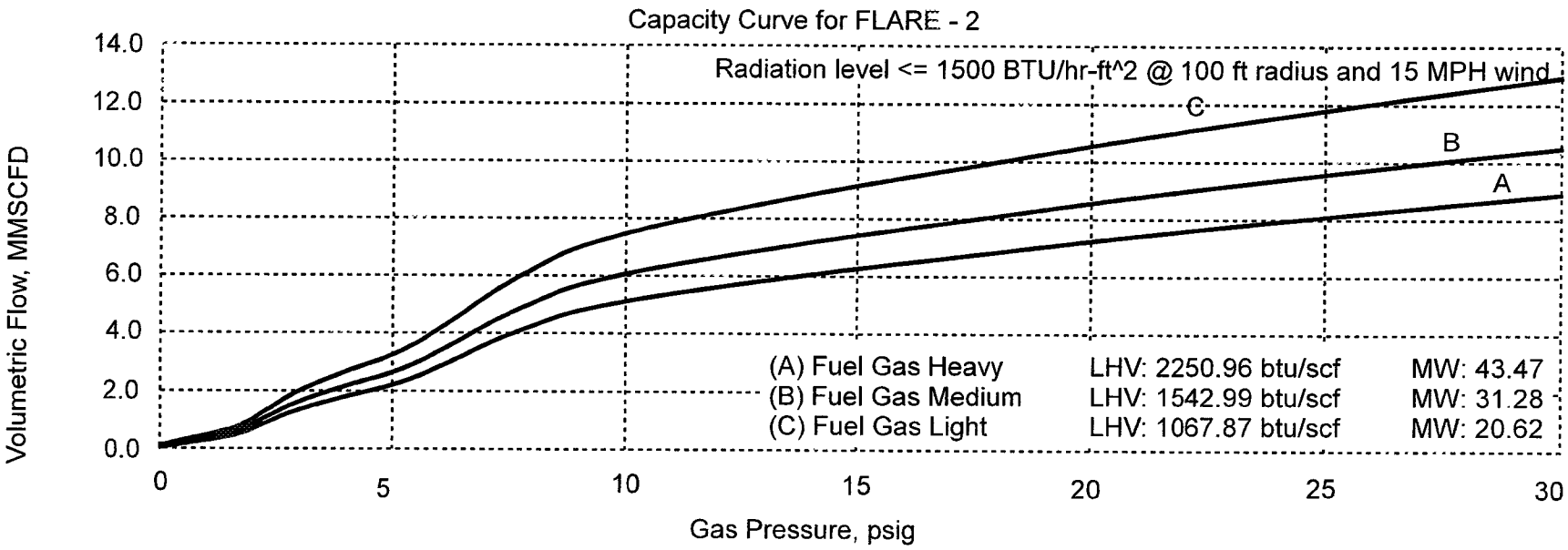

As shown in FIG. 17, the FLARE-2 flare tip assembly in accordance with an embodiment of the present invention can operate at a pressure range of 0 to 30 psig with a volumetric gas flow of 0 to approximately 13 MMSCFD for a light fuel gas.

Figure 18:
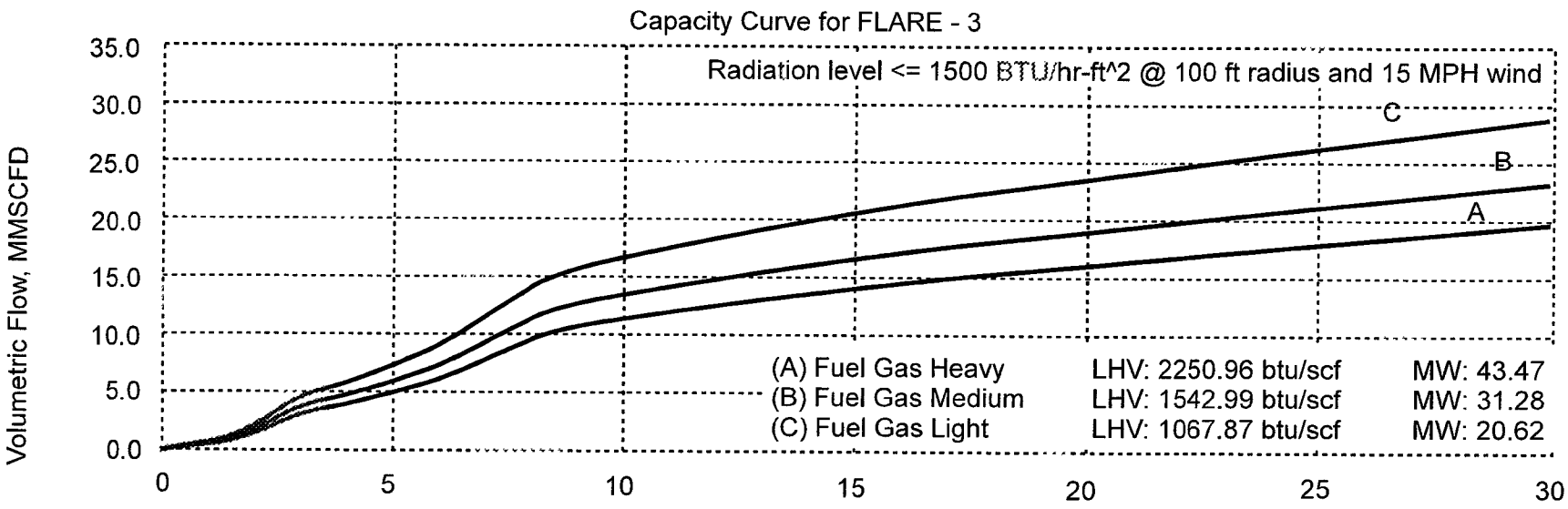

As shown in FIG. 18, the FLARE-3 flare tip assembly in accordance with an embodiment of the present invention can operate at a pressure range of 0 to 30 psig with a volumetric gas flow of 0 to approximately 29 MMSCFD for a light fuel gas.

Figure 19:
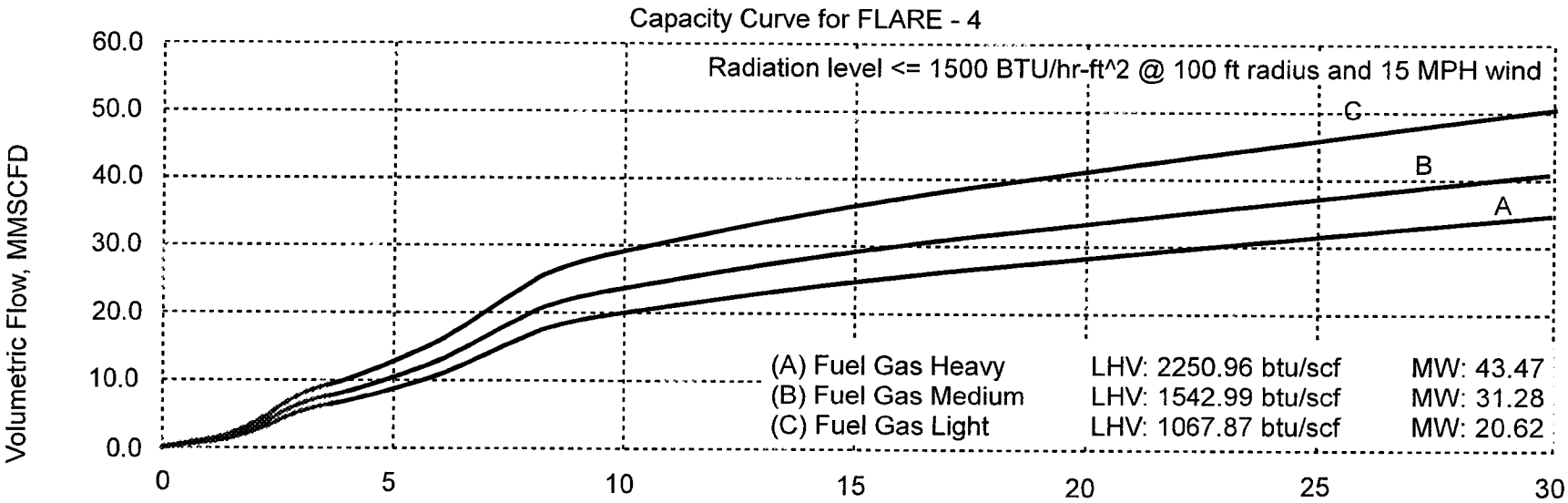

As shown in FIG. 19, the FLARE-4 flare tip assembly in accordance with an embodiment of the present invention can operate at a pressure range of 0 to 30 psig with a volumetric gas flow of 0 to approximately 50 MMSCFD for a light fuel gas.

In a further aspect of an embodiment of the present invention, the upper shroud 114 length, openings 115 quantity, size, and placement further allow for accommodating low and high-pressure vent gas eliminating the need for multiple flares (e.g., a low-pressure flare assembly and a high pressure flare assembly).

This flare tip assembly 100 can be used in a wide range of applications and in certain situations negate the need for multiple flares or pieces of combustion equipment as it can safely flare both sub sonic and sonic flows. It would be suited for applications including those on oil and gas production pads, crude oil tank batteries, midstream liquified natural gas processing facilities, offshore platforms, and refining and petrochemical applications. Embodiments of the present invention can be used in conjunction with other smoke-reducing technologies, such as air-assisted flare, steam-assisted flare for handling heavier fuels and other applications that have poor air/fuel mixing. As mentioned earlier, embodiments of the present invention can be installed on flare stacks for elevated flares. Furthermore, they can also be used for ground flares, enclosed combustors and other combustion devices including thermal oxidizers, etc. Serial and/or parallel uses of multiple embodiments of the present invention can be arranged for applications such as multi-point ground and/or elevated flaring.

Although the apparatuses and methods described herein have been described in detail, it should be understood that various changes, substitutions, and alterations can be made without departing from the spirit and scope of the invention as defined by the following claims. Those skilled in the art may be able to study the exemplar embodiments and identify other ways to practice the invention that are not exactly as described herein. It is the intent of the inventor that variations and equivalents of the invention are within the scope of the claims while the description, abstract and drawings are not to be used to limit the scope of the invention. The invention is specifically intended to be as broad as the claims below and their equivalents.

What is claimed is:

1. A flare tip assembly, comprising:

a) a nozzle tube;

b) a connection end of the nozzle tube adapted for connection to a flare stack;

c) an exit at an opposite end of the nozzle tube opposite the connection end and defining a seat;

d) a cone seated within the seat of the exit of the nozzle tube and movable away from the exit to be unseated and defining an annular orifice between the cone and the exit, the cone having a top and a tapered end;

e) at least one orifice extends through the cone between the tapered end and the top;

f) the top of the cone being concave;

g) the cone sealing the exit of the nozzle tube at low flowrate and low pressure of vapor while vapor flows through the at least one orifice; and h) the cone moving away from the exit of the nozzle tube at high flowrate and high pressure of the vapor.

2. The flare tip assembly in accordance with claim 1, further comprising:

a connecting rod with an end connected to the cone; and a spring connected to the connection rod and biasing the cone against the seat.

3. The flare tip assembly in accordance with claim 1, further comprising:

a rounded edge at a transition from the top of the cone to the tapered end of the cone.

4. The flare tip assembly in accordance with claim 1, further comprising:

the at least one orifice exits through the tapered end of the cone at approximately half a height of the cone.

5. The flare tip assembly in accordance with claim 1, further comprising:

the at least one orifice being axisymmetric and tangential to the cone.

6. The flare tip assembly in accordance with claim 1, further comprising:

the at least one orifice comprising 2 to 12 orifices; and the orifices having a diameter between 1/16 to 1/2 inch.

7. The flare tip assembly in accordance with claim 1, further comprising:

a connecting rod with an end connected to the cone;

an anti-rotation guide with a slot in the nozzle tube with the connecting rod extending therethrough; and a rotation stop rung connected to the anti-rotation guide and in the nozzle tube.

8. A flare tip assembly; comprising:

a) a nozzle tube having a longitudinal axis;

b) a connection end of the nozzle tube adapted for connection to a flare stack;

c) an exit at an opposite end of the nozzle tube opposite the connection end and defining a seat;

d) a tip seated within the seat of the exit of the nozzle tube and movable away from the exit to be unseated and defining an annular orifice between the tip and the exit;

e) at least one orifice passing through the tip and having openings and an axis extending between the openings that is angled with respect to the longitudinal axis of the nozzle tube;

f) the tip sealing the exit of the nozzle tube at low flowrate and low pressure of vapor while vapor flows through the at least one orifice; and g) the tip moving away from the exit of the nozzle tube at high flowrate and high pressure of the vapor;

h) a connecting rod with an end connected to the tip; and i) a spring connected to the connection rod and biasing the tip against the seat.

9. The flare tip assembly in accordance with claim 8, further comprising:

a top of the tip being concave.

10. The flare tip assembly in accordance with claim 8, further comprising;

a) the exit comprising a chamfered end of the nozzle tube opposite the connection end defining a seat;

b) the tip comprises a cone seated within the seat of the chamfered end of the nozzle tube and movable away from the chamfered end to be unseated and defining an annular orifice between the cone and the chamfered end, the cone having a top and a tapered end;

c) orifices through the cone between the top and the tapered end;

d) a connecting rod with an end connected to the cone; and e) a spring assembly connected to the connection rod and biasing the cone against the seat.

11. The flare tip assembly in accordance with claim 8, further comprising;

the tip comprises a cone with a rounded edge at a transition from a top of the cone to a tapered end of the cone.

12. The flare tip assembly in accordance with claim 8, further comprising:

the tip comprises a cone with the at least one orifice exiting through a tapered end of the cone at approximately half a height of the cone.

13. The flare tip assembly in accordance with claim 8, further comprising:

the at least one orifice being axisymmetric and tangential to the tip.

14. The flare tip assembly in accordance with claim 8, further comprising:

the at least one orifice comprising 2 to 12 orifices; and the orifices having a diameter between 1/16 to 1/2 inch.

15. The flare tip assembly in accordance with claim 1, further comprising;

the at least one orifice being angled with respect to a longitudinal axis of the nozzle tube.

16. The flare tip assembly in accordance with claim 8, further comprising:

the at least one orifice being tubular with a constant diameter.

17. The flare tip assembly in accordance with claim 8, further comprising:

the at least one orifice and the nozzle tube being non-concentric.

* * * * *